US007381478B2

(12) United States Patent
Yokoi et al.

(10) Patent No.: US 7,381,478 B2
(45) Date of Patent: Jun. 3, 2008

(54) HOT ROLLED STEEL SHEET FOR PROCESSING AND METHOD FOR MANUFACTURING THE SAME

(75) Inventors: Tatsuo Yokoi, Oita (JP); Tetsuya Yamada, Oita (JP); Osamu Kawano, Oita (JP)

(73) Assignee: Nippon Steel Corporation, Tokyo (JP)

( * ) Notice: Subject to any disclaimer, the term of this patent is extended or adjusted under 35 U.S.C. 154(b) by 68 days.

(21) Appl. No.: 10/573,002

(22) PCT Filed: Sep. 22, 2004

(86) PCT No.: PCT/JP2004/014286

§ 371 (c)(1),
(2), (4) Date: Mar. 20, 2006

(87) PCT Pub. No.: WO2005/028693

PCT Pub. Date: Mar. 31, 2005

(65) Prior Publication Data

US 2007/0037006 A1 Feb. 15, 2007

(30) Foreign Application Priority Data

Sep. 24, 2003 (JP) ..... 2003-332013

(51) Int. Cl.

| | |
|---|---|
| ***B32B 15/00*** | (2006.01) |
| ***B32B 15/04*** | (2006.01) |
| ***B32B 15/18*** | (2006.01) |
| ***C22C 38/00*** | (2006.01) |

(52) U.S. Cl. ..... 428/681; 428/659; 428/684; 420/8

(58) Field of Classification Search ..... 428/658, 428/659, 681, 684; 420/8, 99; 148/320, 148/328

See application file for complete search history.

(56) References Cited

U.S. PATENT DOCUMENTS 6,589,369 B2 7/2003 Yokoi et al.

(Continued)

FOREIGN PATENT DOCUMENTS

EP 0068598 1/1983

(Continued)

OTHER PUBLICATIONS

Supplementary European Search Report for European Application No. 04 77 3463.7 (Oct. 2006).

(Continued)

*Primary Examiner*—Michael La Villa
(74) *Attorney, Agent, or Firm*—Dorsey & Whitney LLP

(57) ABSTRACT

An exemplary hot rolled steel sheet for processing can include, in terms of percent by mass, C of 0.01 to 0.2%; Si of 0.01 to 0.3%; Mn of 0.1 to 1.5%; P of ≦0.1%; S of ≦0.03%; Al of 0.001 to 0.1%; N of ≦0.006%; and as a remainder, Fe and unavoidable impurities. The microstructure may include a main phase in the form of polygonal ferrite and a hard second phase, a volume fraction of the hard second phase is 3 to 20%, a hardness ratio (hardness of the hard second phase/hardness of the polygonal ferrite) is 1.5 to 6, and a grain size ratio (e.g., grain size of the polygonal ferrite/grain size of the hard second phase) is 1.5 or more.

5 Claims, 1 Drawing Sheet

U.S. PATENT DOCUMENTS

2002/0179193 A1* 12/2002 Yokoi et al. ..... 148/332

FOREIGN PATENT DOCUMENTS

| | | | |
|---|---|---|---|
| EP | 1201780 | | 5/2002 |
| JP | 06-172920 | | 6/1994 |
| JP | 06-200351 | | 7/1994 |
| JP | 06-240356 | | 8/1994 |
| JP | 07-070697 | | 3/1995 |
| JP | HI0183301 | | 7/1998 |
| JP | 2000119795 | | 4/2000 |
| JP | 2000169935 | | 6/2000 |
| JP | 2000169936 | | 6/2000 |
| JP | 2000297350 | | 10/2000 |
| JP | 2000309848 | | 11/2000 |
| JP | 2001-220641 | * | 8/2001 |
| JP | 2001220641 | | 8/2001 |
| JP | 2001303186 | | 10/2001 |
| JP | 2002129285 | | 5/2002 |
| JP | 2002-180193 | * | 6/2002 |
| JP | 2002226943 | | 8/2002 |
| JP | 2003049243 | | 2/2003 |
| JP | 2004238687 | | 8/2004 |
| WO | 0181640 | | 11/2001 |

OTHER PUBLICATIONS

Notice of Allowance and Search Report dated Aug. 6, 2007 for counterpart Taiwanese Patent Application No. 093128563.

"Metal Material Fatigue Design Handbook", Society of Materials Science, Japan p. 84, no date.

Tadayoshi et al., "Impact Pressure of Water in Hydraulic Descaling During Hot Strip Mill Rolling", Iron and Steel, 1991 vol. 77 No. 9, no month.

International Search Report for International Patent application No. PCT/JP2004/014286, Feb. 2005.

International Written Opinion for International Patent application No. PCT/JP2004/014286, Feb. 2005.

* cited by examiner

HOT ROLLED STEEL SHEET FOR PROCESSING AND METHOD FOR MANUFACTURING THE SAME

CROSS REFERENCE TO RELATED APPLICATIONS

This application is a national stage application of PCT Application No. PCT/JP2004/014286 which was filed on Sep. 22, 2004 and published on Mar. 31, 2005 as International Publication No. WO 2005/028693 (the "International Application"), the entire disclosure of which is incorporated herein by reference. This application claims priority from the International Application pursuant to 35 U.S.C. § 365. The present application also claims priority under 35 U.S.C. § 119 from Japanese Patent Application No. 2003-332013, filed Sep. 24, 2003, the entire disclosure of which is incorporated herein by reference.

FIELD OF THE INVENTION

The present invention relates to a hot rolled steel sheet for processing having superior bake hardenability after aging, and a method for manufacturing the same.

BACKGROUND INFORMATION

The use of light metals such as aluminum (Al) alloy and high-strength steel sheets for automobile members has been promoted for the purpose of reducing weight in order to improve automobile fuel consumption. The light metals such as Al alloy offer the advantage of high specific strength. However, since such metals are much more costly than steel, their applications are limited to special applications. Thus, there is a need to increase the strength of steel sheet to promote cost decreases and automobile weight reductions over a wider range.

Since increasing the strength of a material typically causes deterioration of moldability (processability) and other material characteristics, one factor to developing high-strength steel sheet is the extent to which strength can be increased without deteriorating material characteristics. Since characteristics such as burring formability, ductility, fatigue durability and corrosion resistance may be important characteristics for steel sheet that are used for inner plate members, structural members and underbody members, and how effectively these characteristics can be balanced with high strength on a high order is important.

For example, Japanese Unexamined Patent Application, First Publication Nos. 2000-169935 and 2000-169936 describe transformation induced plasticity (TRIP) steel in which moldability (ductility and deep drawability) are improved. This may be due to the occurrence of TRIP phenomenon during molding by containing residual austenite in the microstructure of the steel in order to achieve both high strength and various advantageous characteristics, e.g., moldability.

Steel sheet obtained in this area can demonstrate a breaking elongation in excess of 35%, and superior deep drawability (limiting drawing ratio (LDR)) due to the occurrence of TRIP phenomenon by the residual austenite at a strength level of about 590 MPa. However, amounts of elements such as C, Si and Mn should preferably be reduced to obtain steel sheet having strength within the range of 370 to 540 Mpa. When the amounts of elements such as C, Si and Mn are reduced to realize the strength within the range of 370 to 540 MPa, there may be a problem of being unable to maintain amount of residual austenite required for obtaining TRIP phenomenon in the microstructure at room temperature. Thus, it may be difficult to apply high-strength steel sheet having strength of 540 MPa or higher to a member in which steel sheet having strength on the order of 270 to 340 MPa is currently used, without first improving operations and equipment used during pressing. One general known solution is to use steel sheet having strength of about 370 to 490 MPa. On the other hand, a preference for a reduction of gauges is ever increasing to achieve reduction in weight for automobile body. It is therefore important for the reduction in weight for automobile body to maintain pressed product strength, based on the premise of reducing gauges.

Bake-hardening (BH) steel sheet has been described as possibly solving these problems because it has low strength during press molding, and can improve the strength of pressed products as a result of introducing stress due to pressing and subsequent baking finish treatment.

It may be effective to increase solute C and solute N so as to improve bake hardenability. However, increases in these solute elements present in the solid solution can worsen aging deterioration at normal temperatures. Consequently, it is possible to develop a technology that can allow both bake hardenability and resistance to aging deterioration at normal temperatures.

Japanese Patent Application Nos. H09-278697 and 2000-028141 describe technologies for realizing both bake hardenability and resistance to aging deterioration at normal temperatures, in which bake hardenability is improved by increasing the amount of solute N, and the diffusion of solute C and solute N at normal temperatures is inhibited by an effect of increasing grain boundary surface area caused by grain refining of crystal grains.

However, the use of finer crystal grains may have the risk of leading to increases in the yield point and causing deterioration of press moldability. In addition, increasing the amount of solute N can have the advantage of increasing the BH amount. However, there is concern over considerable decreases in the BH amount after aging due to the appearance of yield point elongation caused by aging.

SUMMARY OF EXEMPLARY EMBODIMENTS OF THE INVENTION

The present invention relates to a hot rolled steel sheet for processing and a method for manufacturing the same. Such steel can have a superior bake hardenability after aging within a strength range of 370 to 490 MPa that allows to obtain a stable BH amount of 60 MPa or more since the hot rolled steel sheet has superior press moldability due to having a low yield ratio and there is little decrease in the BH amount due to aging. For example, exemplary embodiments of the present invention can provide a hot rolled steel sheet for processing having superior bake hardenability after aging that allows to stably manufacture pressed product (having strength equivalent to that of pressed product manufactured) by applying a 540 to 640 MPa-class steel sheet as a result of the introduction of pressing stress and baking finish treatment, even when the tensile strength of the hot rolled steel sheet is 370 to 490 MPa, and a method for manufacturing that steel sheet inexpensively and stably.

An exemplary embodiment of the steel sheet having superior bake hardenability after aging (little decrease in the BH amount caused by aging) as well as superior press moldability can be provided, with the emphasis on a production process for 370 to 490 MPa-class steel sheet produced on an industrial scale using ordinary production equipment currently in use.

Thus, an exemplary steel sheet can be made in which C=0.01 to 0.2%, Si=0.01 to 0.3%, Mn=0.1 to 1.5%, P≦0.1%, S≦0.03%, Al=0.001 to 0.1% and N≦0.006%, and as a remainder, Fe and unavoidable impurities is included, wherein the microstructure includes a main phase in the form of polygonal ferrite polygonal ferrite and a hard second phase, a volume fraction of the hard second phase is 3 to 20%, a hardness ratio (hardness of the hard second phase/hardness of the polygonal ferrite) is 1.5 to 6, and a grain size ratio (grain size of the polygonal ferrite/grain size of the hard second phase) is 1.5 or more, and which is effective, to provide the exemplary steel sheet according to an exemplary embodiment of the present invention.

According to one exemplary embodiment of the present invention, a hot rolled steel sheet can be provided which may include, in terms of percent by mass, C of 0.01 to 0.2%; Si of 0.01 to 0.3%; Mn of 0.1 to 1.5%; P of ≦0.1%; S of ≦0.03%; Al of 0.001 to 0.1%; N of ≦0.006%; and as a remainder, Fe and unavoidable impurities. The microstructure can include a main phase in the form of polygonal ferrite and a hard second phase, a volume fraction of the hard second phase is 3 to 20%, a hardness ratio (hardness of the hard second phase/hardness of the polygonal ferrite) is 1.5 to 6, and a grain size ratio (grain size of the polygonal ferrite/grain size of the hard second phase) is 1.5 or more.

In accordance with this exemplary embodiment of the present invention, the hot rolled steel sheet can have a superior bake hardenability after aging. This hot rolled steel sheet may have a superior press moldability due to having a low yield ratio, and can also allow to obtain a stable BH amount of 60 MPa or more, even in the case of having been exposed to an environment such that aging proceeds spontaneously after the steel sheet manufactured. Thus, a pressed product strength can be realized which may be equivalent or similar to that of pressed product manufactured by applying 540 to 640 MPa-class steel sheet, by introduction of pressing stress and baking finish treatment, even when the exemplary steel sheet has tensile strength of 370 to 490 MPa. Therefore, the exemplary embodiment of the steel sheet according to the present invention likely has a high degree of industrial value.

In the exemplary embodiment of the present invention, the exemplary steel may further include at least one of B of 0.0002 to 0.002%, Cu of 0.2 to 1.2%, Ni of 0.1 to 0.6%, Mo of 0.05 to 1%, V of 0.02 to 0.2%, or Cr of 0.01 to 1%, in terms of percent by mass.

In the exemplary embodiment of the present invention, the exemplary steel may further include at least one of Ca of 0.0005 to 0.005% and REM of 0.0005 to 0.02%, in terms of percent by mass.

In the exemplary embodiment of the present invention, the hot rolled steel sheet may be treated with zinc plating.

An exemplary embodiment of a method for manufacturing a hot rolled steel sheet for processing in accordance with the present invention can include: (i) subjecting a slab having: in terms of percent by mass, C of 0.01 to 0.2%; Si of 0.01 to 0.3%; Mn of 0.1 to 1.5%; P of ≦0.1%; S of ≦0.03%; Al of 0.001 to 0.1%; N of ≦0.01%; and as a remainder, Fe and unavoidable impurities to a rough rolling so as to obtain a rough rolled bar; (ii) subjecting the rough rolled bar to a finish rolling so as to obtain a rolled steel under conditions in which a sum of reduction rates of the final stage and the stage prior thereto is 25% or more, the reduction rate of the final stage is 1 to 15%, and a finishing temperature is in a temperature range from $Ar_3$ transformation point temperature to ($Ar_3$ transformation point temperature +100° C.); and (iii) maintaining the rolled steel in a temperature range from below the $Ar_3$ transformation point temperature to the $Ar_1$ transformation temperature or higher for 1 to 15 seconds and then cooling to 350° C. at a cooling rate of 100° C./sec or more so as to obtain a hot rolled steel sheet, and coiling the hot rolled steel sheet at a temperature of below 350° C.

In the exemplary embodiment of the present invention, a starting temperature of the finish rolling may be set to ($Ar_3$ transformation point temperature +250° C.) or higher.

In the exemplary embodiment of the present invention, the rough rolled bar or the rolled steel may be heated during the time until the start of the step of subjecting the rough rolled bar to the finish rolling and/or during the step of subjecting the rough rolled bar to the finish rolling.

In the exemplary embodiment of the present invention, descaling may be carried out during the time from the end of the step of subjecting the slab to the rough rolling to the start of the subjecting of the rough rolled bar to the finish rolling.

In the exemplary embodiment of the present invention, the resulting hot rolled steel sheet may be immersed in a zinc plating bath so as to galvanize the surface of the hot rolled steel sheet.

Further, an alloying treatment may be carried out after galvanizing.

These and other objects, features and advantages of the present invention will become apparent upon reading the following detailed description of embodiments of the invention, when taken in conjunction with the appended claims.

BRIEF DESCRIPTION OF THE DRAWINGS

Further objects, features and advantages of the invention will become apparent from the following detailed description taken in conjunction with the accompanying figure showing illustrative embodiment(s), result(s) and/or feature(s) of the exemplary embodiment(s) of the present invention, in which.

DETAILED DESCRIPTION OF EXEMPLARY EMBODIMENTS OF INVENTION

Figure 1:
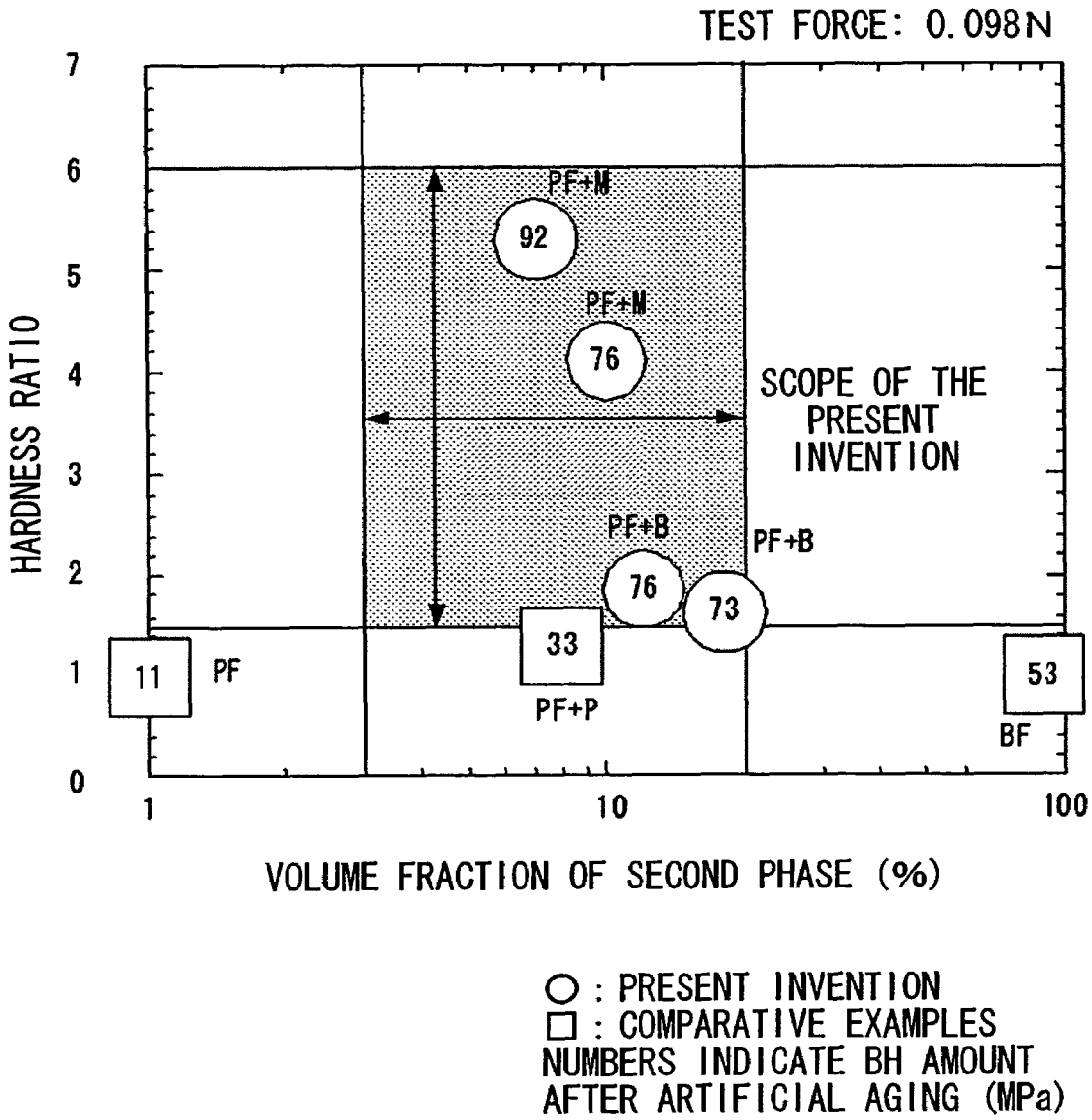
FIG. 1 is a graph in which the hardness ratio of steel sheet samples is plot against the volume fraction of the hard second phase.

The following experiment was conducted to investigate the relationship between bake hardenability after aging and steel sheet microstructure. Slabs having the steel components shown in Table 1 were melted to prepare steel sheets having a thickness of 2 mm produced in various production processes, and then their bake hardenability after aging and their microstructure were examined.

TABLE 1

| (% by mass) | | | | | | |
|---|---|---|---|---|---|---|
| C | Si | Mn | P | S | Al | N |
| 0.068 | 0.061 | 1.22 | 0.009 | 0.001 | 0.034 | 0.0029 |

Bake hardenability after aging was evaluated in accordance with the following exemplary procedure. No. 5 test pieces as described in JIS Z 2201 were cut out of each steel sheet, and the test pieces were subjected to artificial aging treatment for 60 minutes at 100° C. Furthermore, preliminary tensile strain of 2% was applied to the test pieces, and then the test pieces were subjected to heat treatment equivalent to a baking finish treatment at 170° C. for 20 minutes, after which the tensile test was carried out again. The tensile test was carried out in accordance with the method of JIS Z 2241.

In this manner, superior bake hardenability after aging can indicate a large BH amount after artificial aging treatment. In addition, the BH amount is defined as the value obtained by subtracting a flow stress of the preliminary tensile strain of 2% from the upper yield point obtained in the repeated tensile test.

On the other hand, a microstructure was investigated in accordance with the following exemplary method. Samples cut out from a location of ¼W or ¾W of the width (W) of the steel sheets were ground along the cross-section in the direction of rolling, and then were etched using a nital reagent. Photographs were taken of the fields at ¼t and ½t of the sheet thickness (t) and at a depth of 0.2 mm below a surface layer at 200-fold to 500-fold magnification using a light microscope.

A volume fraction of the microstructure can be defined as the surface fraction in the aforementioned photographs of the metal structure. Further, the measurement of average crystal grain sizes of the polygonal ferrite and the second phase may be carried out using the exemplary comparison method described in JIS G 0552. Value m of the crystal grains per 1 $mm^2$ of the cross-sectional area can be determined from the grain size number G determined from the measured values obtained by that comparison method using the equation of $m=8\times2^G$. Thereafter, the average crystal grain size $d_m$ obtained from this value of m using the equation of $d_m=1/\sqrt{m}$ may be defined as the average crystal grain size of the polygonal ferrite and the second phase.

For measuring the average crystal grain size, a method in which the aforementioned images observed using a light microscope may be scanned to an image processing apparatus, and an equivalent circular diameter may be determined to be used as the average crystal grain size. The grain size ratio of the main phase in the form of polygonal ferrite to the second phase may be defined as the average crystal grain size of the polygonal ferrite (dm)/average crystal grain size of the second phase (ds).

Moreover, the hardness ratio of the hard second phase to the main phase in the form of polygonal ferrite can be the Vickers hardness of the hard second phase (HV(s))/Vickers hardness of the main phase (Hv(m)). The Vickers hardness values of the hard second phase and the main phase may be the average values obtained by, e.g., measuring at least 10 points each in accordance with the method described in JIS Z 2244 and taking the average of values in which their respective maximum and minimum values are excluded.

The BH amount after aging, volume fraction of the second phase, and hardness ratio were measured in accordance with the methods described above, and the results are shown in FIG. 1. In the graph of FIG. 1, the steel sheets in which the volume fraction of the hard second phase is 3 to 20% and the hardness ratio is 1.5 to 6 are plotted with circles, while other steel sheets are plotted with squares. In addition, the BH amounts after aging of the steel sheets are indicated as numerical values inside the plotted points of those steel sheets.

The microstructures of the steel sheets are described near the plotted points. As shown in FIG. 1, PF indicates polygonal ferrite, BF indicates bentonitic ferrite, M indicates martensite, B indicates bainite and P indicates pearlite.

Illustrated in FIG. 1, BH amount after aging, the volume fraction of the second phase, and the hardness ratio demonstrate an extremely strong correlation, and it was newly found that the BH amount after aging is 60 MPa or more in the case in which the volume fraction of the second phase is 3 to 20% and the hardness ratio is 1.5 to 6.

In the case in which a hard second phase is included in the microstructure in the optimum state (as for such as volume fraction and hardness ratio), numerous mobile dislocations may be introduced as a result of the second hard phase undergoing a transformation at low temperatures at the time of production. If these mobile dislocations are introduced to a certain degree, the occurrence of yield point elongation and increases in the yield point may be inhibited even after aging, and strain caused by processing can be effectively reflected in the BH amount.

The following description provides a more detailed explanation of the microstructure of a steel sheet according to an exemplary embodiment of the present invention.

According to one such embodiments of the present invention, it is necessary that the microstructure includes polygonal ferrite and a hard second phase, and the hard second phase is either martensite or bainite. When the hard second phase is martensite, since martensite has greater volumetric expansion and allows the introduction of a larger number of mobile dislocations than bainite, the yield point can be further lowered and the BH amount can be increased. Therefore, the hard second phase may likely be martensite. However, residual austenite is allows up to about 3%, which is the level at which it is likely unavoidably contained.

As described above, it is required that the volume fraction of the second phase is 3 to 20% and the hardness ratio is 1.5 to 6 in order to realize both processability and superior bake hardenability after aging.

When the hard second phase is less than 3%, a sufficient amount of mobile dislocations for inhibiting occurrence of yield point elongation even after aging and preventing lowering of the BH amount, may not necessarily be obtained. However, in the case in which the hard second phase exceeds 20%, the volume fraction of the main phase in the form of polygonal ferrite decreases, likely resulting in deterioration of processability. Thus, to obtain a high BH amount even after aging, the volume fraction of the second phase should preferably be 3 to 20%.

When the hardness ratio of the hard second phase to the main phase in the form of polygonal ferrite is less than 1.5, a sufficient amount of mobile dislocations may not be obtained for inhibiting occurrence of yield point elongation even after aging and preventing lowering of the BH amount. However, when the hardness ratio exceeds 6, the effects are likely saturated. Thus, the hardness ratio should preferably be from 1.5 to 6.

On the other hand, the main phase can be made to be polygonal ferrite in order to obtain superior processability, and in addition, in order to obtain this effect, it is necessary that the grain size ratio of the polygonal ferrite to the second phase is 1.5 or more. In the case in which the grain size ratio of the polygonal ferrite to the second phase is less than 1.5, ductility decreases due to the influence of the hard second phase. Furthermore, if the hard second phase is a phase in which dissolved elements can be concentrated, and hardness may have increased in the manner of martensite, the grain size of the second phase inevitably may become smaller. Since this results in greater resistance to the effects of the hard second phase. Thereby, ductility can be improved, the crystal grain size is preferably 2.5 or more.

In addition, in the case in which the average grain size of the polygonal ferrite is greater than 8 μm, yield stress decreases, and thereby, moldability can be improved. Therefore, the average grain size can preferably be greater than 8 μm. There is no particular requirement of any upper limit of the average grain size of the polygonal ferrite. However, it may be preferably 25 μm or less from the viewpoint of surface roughness.

In addition, the maximum height Ry of the steel sheet surface can preferably be 15 μm (15 μm Ry, 1 [standard length: sampling length] 2.5 mm, in [evaluation length: traveling length) 12.5 mm] or less). This may be due (as is described, for example, on page 84 of the Metal Material Fatigue Design Handbook, Society of Materials Science, Japan) to the fatigue strength of hot rolled or acid washed steel sheet is clearly correlated with the maximum height Ry of the steel sheet surface.

According to an exemplary embodiment of the present invention, not only is the BH amount at the preliminary strain of 2% superior evaluated as previously described, but also the BH amount at the preliminary strain of 10% is 40 MPa or more even in the case of N≦0.006%, and an amount of increase in tensile strength (ΔTS) at the preliminary strain of 10% is 40 MPa or more.

The following description provides an explanation of the reason for limiting the chemical components of exemplary embodiments according to the present invention.

Where the content of C is less than 0.01%, adequate hardness and volume fraction for the second phase may not be obtained for inhibiting aging deterioration, and the amount of C that is able to be present in a state of solid solution in the steel sheet can decrease, which may result in the risk of causing a decrease in the BH amount. Therefore, the content of C should preferably be 0.01% or more. In addition, when the content of C is more than 0.2%, the volume fraction of the second phase may increase, and thus, strength can be increased, which in turn results in deterioration of processability. Therefore, the content of C should be 0.2% or less. Moreover, the content of C is preferably 0.1% or less in the case of utilizing a certain degree of hole expandability.

Si and Mn are important elements for the exemplary embodiment of the present invention. These elements can be included at specific amounts in order to obtain the required compound structure which includes polygonal ferrite and the second phase of the exemplary embodiment of the present invention, despite having low strength of 490 MPa or less. Mn may have the effect of expanding the temperature range of the ferrite and austenite dual phase state during cooling after completion of rolling and facilitates the obtaining of the required compound structure including polygonal ferrite and the second phase of the exemplary embodiment of the present invention. Therefore, Mn may be included at a content of 0.1% or more. However, since the effect of Mn is saturated when included at a content of more than 1.5%, the upper limit can be made to be 1.5%.

On the other hand, since Si may have the effect of inhibiting precipitation of iron carbides during cooling, Si can be included at a content of 0.01% or more. However, if included in excess of 0.3%, its effect may act excessively, which can make it difficult to obtain the compound structure including polygonal ferrite and the second phase. Moreover, in the case in which the content of Si is more than 0.3%, there may cause a deterioration of the processability for phospating. Therefore, the upper limit of the content of Si may preferably be 0.3%. In addition, when elements other than Mn that inhibit occurrence of hot cracks due to S are not appropriately provided or included, Mn is preferably provided such that the contents of Mn and S satisfy an equation of Mn/S≧20 in terms of percent by mass. Moreover, when Mn is provided or included so that the contents of Si and Mn satisfy Si+Mn of more than 1.5%, strength can become excessively high, and this may cause a deterioration of processability. Therefore, the upper limit of the content of Mn may preferably be 1.5%.

P is an impurity and its content should preferably be as low as possible. When the content of P is more than 0.1%, P can cause negative effects on processability and weldability. Therefore, the content of P should preferably be 0.1% or less. However, the content of P may also preferably be 0.02% or less in consideration of hole expanding and weldability.

Since S not only can cause cracking during hot rolling but may also form A type inclusions that cause deterioration of hole expanding if excessively large amount of S is present, the content of S should preferably be made to be as low as possible. Allowable or possible range for the content of S may be 0.03% or less. However, when a certain degree of hole expanding is used, it is preferable that the content of S is 0.001% or less, and in cases in which a high degree of hole expanding is used, it is preferable that the content of S is 0.003% or less.

Al should be included at a content of 0.001% or more for the purpose of deoxidation of molten steel; however, its upper limit is made to be 0.1% since Al leads to increased costs. In addition, since Al may cause increases in amount of non-metallic inclusions resulting in deterioration of elongation if excessively large amount of Al is included, it is preferable that the content of Al is 0.06% or less. Moreover, it is preferable that the content of Al is 0.015% or less in order to increase the BH amount.

N is typically a preferable element for increasing the BH amount. However, since aging deterioration can become considerable if N is included at a content of more than 0.006%, the content of N should be 0.006% or less. Moreover, in the case of being premised on allowing to stand for two weeks or more at room temperature after production and then using for processing, the content of N is preferably added at 0.005% or less from the viewpoint of aging. In addition, the content of N can preferably be less than 0.003% when considering allowing to stand at high temperatures during the summer or when exporting across the equator during transport by a marine vessel.

B can improve a quench hardenability, and may be effective in facilitating the obtaining of the required compound structure including polygonal ferrite and the second phase of the present invention. Therefore, B may be included. However, when the content of B is less than 0.0002%, such content may be inadequate for obtaining that effect, while in the case in which the content of B is more than 0.002%, cracking of the slabs occurs. Accordingly, the content of B can be from 0.0002% to 0.002%.

Moreover, for the purpose of imparting strength, any one or more of alloying elements for precipitation or alloying elements for solid solution may be included that are selected from Cu at a content of 0.2 to 1.2%, Ni at a content of 0.1 to 0.6%, Mo at a content of 0.05 to 1%, V at a content of 0.02 to 0.2% and Cr at a content of 0.01 to 1%. In the case in which the contents of any of these elements are less than the aforementioned ranges, its effect is unable to be obtained. When contents of such element(s) exceed the aforementioned ranges, the effect can become saturated and there may be no further increases in effects even if the contents are increased.

Ca and REM are elements which change forms of non-metallic inclusions acting as origins of breakage and causing deterioration of processability, and then can eliminate their harmful effects. However, they may not be effective if included at contents of less than 0.0005%, while their effects are saturated if Ca may be included at a content of more than 0.005% or REM is included at a content of more than 0.02%. Thus, Ca may preferably be included at a content of 0.0005 to 0.005%, while REM may preferably be included at a content of 0.0005 to 0.02%.

In this manner, steel having these for their main components may further include Ti, Nb, Zr, Sn, Co, Zn, W or Mg on condition that the total content of these elements is 1% or less. However, since there is the risk of Sn causing imperfections during hot rolling, the content of Sn is preferably 0.05% or less.

The following provides a detailed description of a possible reason to provide the method for manufacturing a hot rolled steel sheet according to the exemplary embodiment of the present invention.

For example, a hot rolled steel sheet of an exemplary embodiment of the present invention can be produced using a method in which slabs are hot rolled after casting and then cooled, a method with which the rolled steel or hot rolled steel sheet after hot rolling is further subjected to heat treatment on a hot-dip coating line, and/or a method which further includes other surface treatment on these steel sheets.

The exemplary method for manufacturing the hot rolled steel sheet of the exemplary embodiment of the present invention can include a method for subjecting a slab to a hot rolling so as to obtain a hot rolled steel sheet, rough rolling the slab so as to obtain a rough rolled bar (also referred to as a sheet bar), finish rolling the rough rolled bar so as to obtain a rolled steel, and cooling the rolled steel so as to obtain the hot rolled steel sheet.

There are no limitations on the exemplary embodiments of the method according to the present invention carried out prior to the hot rolling procedure, e.g., the method for manufacturing the slab. For example, slabs may be manufactured by melting with a blast furnace, a converter or an electric arc furnace, followed by performing various types of secondary refining for adjusting the components so as to have the target component contents, and then casting using a method such as ordinary continuous casting, casting using the ingot method or thin slab casting. Scrap may be used for the raw material. When using slabs obtained by the continuous casting, hot cast slabs may be fed directly to a hot rolling machine, or the slabs may be hot rolled after cooling to room temperature and then reheating in a heating oven.

There are no particular limitations on the temperature for reheating the slabs; however, in the case in which the temperature is about 1400° C. or higher, the amount of scale removed becomes excessive, resulting in a decrease in yield. Therefore, the reheating temperature may preferably be lower than about 1400° C. In addition, when heating at a temperature of lower than 1000° C., operating efficiency can be considerably impaired in terms of scheduling. Therefore, the reheating temperature for the slabs can preferably be about 1000° C. or higher. Moreover, in the case of reheating at a temperature of lower than 1100° C., the amount of scale removed becomes small, thereby it is possible that inclusions in the surface layer of the slab may not be removed together with the scales by subsequent descaling. Therefore, the reheating temperature for the slabs can be preferably about 1100° C. or higher.

The hot rolling step/procedure includes a rough rolling step/procedure and a finish rolling step/procedure carried out after completion of that rough rolling, and a starting temperature of finish rolling can preferably be $Ar_3$ transformation point temperature +250° C. or higher, in order to inhibit material variations in the direction of sheet thickness. There is no specific upper limit of the starting temperature of finish rolling. However, when the temperature exceeds 1250° C., there may be a risk that the finishing temperature at completion of finish rolling exceeds $Ar_3$ transformation point temperature +250° C. Therefore, the starting temperature of finish rolling may preferably be about 1250° C. or lower. In order to make the starting temperature of finish rolling equal to or higher than $Ar_3$ transformation point temperature +250° C., the rough rolled bar or the rolled steel can be heated during the time from the end of the rough rolling to the start of the finish rolling and/or during the finish rolling, as necessary.

In order to obtain stable and superior breaking elongation according to one exemplary embodiment of the present invention, it may be effective to inhibit the fine precipitation of MnS. Normally, precipitates such as MnS are redissolved in a solid solution during reheating of the slabs at about 1250° C., and finely precipitate during subsequent hot rolling. Thus, ductility can be improved by controlling the reheating temperature of the slabs to about 1150° C. so as to prevent MnS from being redissolved in the solid solution. However, in order to make the finishing temperature at completion of rough rolling to be within the range of the exemplary embodiment of the present invention, it can be an effective way to heat the rough rolled bar or the rolled steel during the time from the end of rough rolling to the start of finish rolling and/or during finish rolling. Any type of system or arrangement may be used for the heating apparatus according to the exemplary embodiment of the present invention. However, a transverse system may be preferable since it can enable heating uniformly in the direction of sheet thickness.

When descaling is performed during the time from the end of the rough rolling to the start of the finish rolling, it may be preferable that a collision pressure P (MPa) and a flow rate L (liters/$cm^2$) of high-pressure water on the surface of the steel sheet satisfy the conditional expression of $P \times L \geqq 0.0025$.

The collision pressure P of the high-pressure water on the surface of the steel sheet can be described in the following manner (see "Iron and Steel", 1991, Vol. 77, No. 9, p. 1450):

$$P(MPa)=5.64\times P_0\times V/H^2$$

where $P_0$ (MPa): Liquid pressure

V (liters/min): Flow rate of liquid from nozzle

H (cm): Distance between surface of steel sheet and nozzle

Flow rate L is described in the following manner

L (liters/$cm^2$)=V/(W×v) and where,

V (liters/min): Flow rate of liquid from nozzle

W (cm): Width of spraying liquid that contacts the surface of the steel sheet per nozzle v (cm/min): Sheet transport speed It is not necessary to specify the upper limit of value of collision pressure P×flow rate L in order to obtain the effects of the exemplary embodiment of the present invention. However, the upper limit of the value of collision pressure P×flow rate L can preferably be about 0.02 or less, since excessive nozzle wear and other problems may occur when the nozzle liquid flow rate is increased.

As a result of descaling, the scale can be removed from the surface such that the maximum height Ry of the steel sheet surface is 15 μm (15 μm Ry, 1 (standard length: sampling length) 2.5 mm, In (evaluation length: traveling length) 12.5 mm) or less. In addition, the subsequent finish rolling can preferably be carried out within 5 seconds after the descaling so as to prevent reformation of scale.

In addition, sheet bars may be joined between the rough rolling and the finish rolling, and the finish rolling may be carried out continuously. At that time, the rough rolled bar may be temporarily coiling into the shape of a coil, put in a cover having a warming function if necessary, and then joined after uncoiling.

It is necessary to suitably promote ferrite transformation after completion of rolling in order to obtain the desired fractions of the microstructure and hardness ratio between the main phase and the second phase in this component system. Therefore, it is necessary that the finish rolling be carried out under conditions in which a sum of reduction rates of the final stage and the stage prior thereto is 25% or more. When the reduction rate of the final stage is less than 1%, the flatness of the steel sheet deteriorates, while in the case in which it exceeds 15%, ferrite transformation proceed significantly. Thus, the desired microstructure in which the grain size ratio of the polygonal ferrite to the second stage is 2.5 or more may not be obtained. Therefore, the reduction rate of the final stage should be 1 to 15%. An upper limit may not be particularly provided for the sum of reduction rates of the final stage and the stage prior thereto; however, it is preferably 50% or less in consideration of equipment restrictions due to rolling reaction force.

Moreover, finishing temperature (FT) at completion of the finish rolling should preferably be in a temperature range from $Ar_3$ transformation point temperature to $Ar_3$ transformation point temperature +100° C. The $Ar_3$ transformation point temperature can be indicated with, for example, the relationship with the steel components in accordance with the following calculation formula.

For example, $$Ar_3=910-310\times\%\ C+25\times\%\ Si-80\times\%\ Mneq,$$ where $Mneq=\%\ Mn+\%\ Cr+\%\ Cu+\%\ Mo+\%\ Ni/2+10(\%\ Nb-0.02)$, and/or, in the case of including B, $$Mneq=\%\ Mn+\%\ Cr+\%\ Cu+\%\ Mo+\%\ Ni/2+10(\%\ Nb-0.02)+1.$$

In this manner, the parameters of % C, % Si, % Mn, % Cr, % Cu, % Mo, % Ni, and % Nb in the formula can indicate the respective contents (mass %) of elements C, Si, Mn, Cr, Cu, Mo, Ni and Nb in the slabs.

When the finishing temperature (FT) at completion of finish rolling is lower than the $Ar_3$ transformation point temperature, there is the possibility of $\alpha+\gamma$ two-phase-rolling. Thus, the processed structure can remain in the ferrite grains after rolling, possibly resulting in the risk of deterioration of ductility. Therefore, FT may be made to be equal to or higher than the Ar3 transformation point temperature. In addition, when the finishing temperature (FT) at completion of finish rolling exceeds the $Ar^3$ transformation point temperature +100° C., the strain which may be caused by rolling and used for ferrite transformation after completion of rolling, may be alleviated by a recrystallization of austenite. Thus, the target microstructure is not obtained at the end. Therefore, the finishing temperature (FT) at completion of finish rolling may be $Ar_3$ transformation point temperature of +100° C. or lower.

After the completion of the finish rolling, the temperature can be maintained for about 1 to 15 seconds within the temperature range of two-phase of $\alpha+\gamma$ that is below the $Ar_3$ transformation point temperature and equal to or higher than the $Ar_1$ transformation temperature. In the case in which the duration of this holding procedure is less than about 1 second, the phase separation of ferrite phase and austenite phase may not proceed sufficiently. Thereby, the target microstructure may not be obtained at the end. Therefore, the $Ar_1$ transformation temperature can be indicated by, for example, the relationship with the steel components in accordance with the following calculation formula:

$$Ar_1=830-270\times\%\ C-90\times\%\ Mneq$$

On the other hand, when the duration of that holding exceeds 15 seconds, not only there may be a risk of being unable to obtain the target microstructure due to the formation of pearlite, but also the sheet passage rate can decrease which may result in a considerable reduction in productivity. Therefore, the time during which the steel sheet may be maintained in that temperature range for about 1 to 15 seconds. The amount of cooling until the temperature reaches that held temperature is not particularly specified. However, the steel sheet may be preferably cooled to this temperature range at a cooling rate of about 20° C./sec or more so as to promote separation of $\alpha$ and $\gamma$ phases. Further, after the completion of holding at the above temperature, the steel sheet is cooled to 350° C. at a cooling rate of 100° C./sec or more and then coiled at a temperature below 350° C. In the case in which the steel sheet is cooled at a cooling rate of less than 100° C./sec, pearlite ends up forming which prevents the obtaining of a second phase of sufficiently hard; thereby, the target microstructure cannot be obtained. Therefore, adequate bake hardenability is unable to be secured. Thus, the cooling rate is made to be 100° C. or more. The effects of the present invention can be obtained without particularly specifying the upper limit of the cooling rate; however, since there is concern over warping of the sheet caused by thermal strain, it is preferably 200° C./s or less.

When a coiling temperature is 350° C. or higher, a hardness ratio of 1.5 to 6 which is necessary to obtain sufficient mobile dislocations for lowering the BH amount without causing yield point elongation after aging, is not achieved. Therefore, the coiling temperature should be lower than 350° C. Moreover, the coiling temperature can be preferably 150° C. or less from the viewpoint of resistance to aging deterioration. In addition, it is not particularly necessary to limit the lower limit of the coiling temperature. However, since a defective appearance caused by the presence of rust if the coil remains wet for a long period of time may be concerning, the coiling temperature can preferably be about 50° C. or higher.

After the completion of the hot rolling step, an acid washing procedure may be carried out if desired, and then a skinpass procedure performed at a reduction rate of 10% or less, or a cold rolling procedure performed at a reduction rate of up to about 40% may be carried out either offline or inline.

Furthermore, the skinpass rolling procedure can be preferably carried out at 0.1% to 0.2%, e.g., to correct the shape of the steel sheet and to improve ductility due to introduction of mobile dislocations.

In order to subject the hot rolled steel sheet after acid washing to zinc plating, the hot rolled steel sheet may be immersed in a zinc plating bath and if desired, subjected to an alloying treatment.

EXAMPLES

The following provides a more detailed explanation of the present invention through its examples.

After steels A to K having the chemical components shown in Table 2 were melted using a converter and were subjected to continuous casting, these steels were either sent directly to rough rolling or reheated prior to rough rolling, and then were subjected to rough rolling and finish rolling so as to make sheet thickness 1.2 to 5.5 mm, and were coiled. The chemical compositions shown in the table are indicated in percent by mass (mass%).

TABLE 2

| Slab No. | Chemical Composition (unit: mass %) C | Si | Mn | P | S | Al | N | Si + Mn | Other |
|---|---|---|---|---|---|---|---|---|---|
| X1 | 0.071 | 0.06 | 1.21 | 0.011 | 0.001 | 0.031 | 0.0026 | 1.27 | |
| X2 | 0.048 | 0.22 | 0.72 | 0.010 | 0.001 | 0.033 | 0.0038 | 0.94 | Cu: 0.29%, Ni: 0.12% |
| X3 | 0.074 | 0.07 | 1.01 | 0.011 | 0.001 | 0.028 | 0.0027 | 1.08 | B: 0.004%, Cr: 0.08% |
| X4 | 0.051 | 0.04 | 0.98 | 0.009 | 0.001 | 0.031 | 0.0029 | 1.02 | Mo: 0.11% |
| X5 | 0.072 | 0.05 | 1.08 | 0.009 | 0.001 | 0.016 | 0.0030 | 1.13 | V: 0.08% |
| X6 | 0.066 | 0.05 | 1.23 | 0.008 | 0.001 | 0.024 | 0.0028 | 1.28 | REM: 0.0009% |
| X7 | 0.063 | 0.04 | 1.31 | 0.010 | 0.001 | 0.026 | 0.0024 | 1.35 | Ca: 0.0014% |
| X8 | 0.052 | 0.03 | 1.02 | 0.010 | 0.001 | 0.034 | 0.0038 | 1.05 | Cr: 0.61% |
| Y1 | 0.070 | 1.02 | 0.36 | 0.008 | 0.001 | 0.035 | 0.0041 | 1.38 | |
| Y2 | 0.070 | 0.03 | 1.26 | 0.012 | 0.001 | 0.015 | 0.0084 | 1.29 | |
| Y3 | 0.210 | 1.51 | 1.49 | 0.010 | 0.001 | 0.033 | 0.0036 | 3.00 | |
| Y4 | 0.064 | 0.89 | 1.26 | 0.010 | 0.001 | 0.034 | 0.0038 | 2.15 | |

The exemplary details of the exemplary production conditions are shown in Table 3. In this table, "heating rough rolled bar" indicates heating of the rough rolled bar or the rolled steel during the time from the end of rough rolling to the start of finish rolling and/or during finish rolling, and indicates whether or not this heating has been carried out. "FT" indicates the finishing temperature at completion of finish rolling, "Holding time" indicates the air-cooling time in the temperature range from below the $Ar_3$ transformation point temperature to equal to or higher than the $Ar_1$ transformation temperature, "Cooling rate from holding temperature range to 350° C." indicates the average cooling rate when the rolled steels were cooled in the temperature range from the holding temperature range to 350° C., and "CT" indicates the coiling temperature. "MT" indicates the temperature measured using a runout table intermediate thermometer, it is equivalent to the temperature at which cooling is started during "cooling from the holding temperature range to 350° C." in the examples.

As shown in Table 3, descaling was carried out in Example 3 under conditions of a collision pressure of 2.7 MPa and flow rate of 0.001 liters/$cm^2$ after rough rolling. In addition, zinc plating was carried out in Example 8.

TABLE 3

| | Production Conditions Slab No. | Heating rough rolled bar | Temperature at start of finish rolling (° C.) | $Ar_3$ + 250 (° C.) | (Reduction rate of final stage)/(Sum of reduction rates of final stage and stage prior thereto) (%/%) |
|---|---|---|---|---|---|
| Ex. 1 | X1 | Yes | 1100 | 1044 | 14/36 |
| Ex. 2 | X1 | No | 1100 | 1044 | 14/36 |
| Ex. 4 | X3 | No | 1100 | 1059 | 10/24 |
| Ex. 7 | X6 | Yes | 1100 | 1043 | 14/36 |
| Ex. 8 | X7 | Yes | 1100 | 1038 | 14/36 |
| Ex. 9 | X1 | Yes | 980 | 1044 | 14/36 |
| Ex. 10 | X1 | Yes | 1000 | 1044 | 14/36 |
| Comp. Ex. 1 | X1 | Yes | 1100 | 1044 | 16/22 |
| Comp. Ex. 2 | X1 | Yes | 1100 | 1044 | 14/36 |
| Comp. Ex. 3 | X1 | Yes | 1100 | 1044 | 14/36 |
| Comp. Ex. 4 | X1 | Yes | 1100 | 1044 | 14/36 |
| Comp. Ex. 5 | X1 | Yes | 1100 | 1044 | 18/36 |
| Comp. Ex. 6 | Y1 | No | 1100 | 1136 | 14/36 |
| Comp. Ex. 7 | Y2 | No | 1100 | 1038 | 14/36 |
| Comp. Ex. 8 | Y3 | Yes | 1100 | 1014 | 10/26 |

| | Production Conditions FT (° C.) | $Ar_3$ (° C.) | $Ar_3$ + 100 (° C.) | $Ar_1$ (° C.) | MT# (° C.) | Holding time (sec) | Cooling rate from holding temp. to 350° C. (° C./sec) | CT (° C.) | Comments |
|---|---|---|---|---|---|---|---|---|---|
| Ex. 1 | 850 | 794 | 894 | 712 | 720 | 4.0 | 120 | <150 | |
| Ex. 2 | 850 | 794 | 894 | 712 | 720 | 4.0 | 120 | <150 | |
| Ex. 4 | 870 | 809 | 909 | 714 | 720 | 5.0 | 110 | 200 | |
| Ex. 7 | 850 | 793 | 893 | 711 | 720 | 5.0 | 110 | 200 | |
| Ex. 8 | 850 | 788 | 888 | 710 | 720 | 5.0 | 110 | 200 | *2 |
| Ex. 9 | 850 | 794 | 894 | 702 | 710 | 4.0 | 120 | <150 | |
| Ex. 10 | 850 | 794 | 894 | 702 | 710 | 4.0 | 120 | <150 | |
| Comp. Ex. 1 | 850 | 794 | 894 | 712 | 780 | 4.0 | 120 | <150 | |
| Comp. Ex. 2 | 780 | 794 | 894 | 712 | 720 | 4.0 | 120 | <150 | |

TABLE 3-continued

| | | | | | | | | |
|---|---|---|---|---|---|---|---|---|
| Comp. Ex. 3 | 850 | 794 | 894 | 712 | 780 | 0.5 | 120 | <150 |
| Comp. Ex. 4 | 850 | 794 | 894 | 712 | 720 | 4.0 | 10 | 500 |
| Comp. Ex. 5 | 850 | 794 | 894 | 702 | 710 | 4.0 | 120 | <150 |
| Comp. Ex. 6 | 890 | 886 | 986 | 749 | 750 | 4.0 | 120 | <150 |
| Comp. Ex. 7 | 850 | 788 | 888 | 710 | 720 | 4.0 | 120 | <150 |
| Comp. Ex. 8 | 875 | 764 | 864 | 751 | 760 | 5.0 | 110 | 400 |

| | Microstructure | | | | Mechanical Properties | | | Bake Hardenability | |
|---|---|---|---|---|---|---|---|---|---|
| | Microstructure | volume fraction of Second phase (%) | Hardness ratio | Crystal grain size ratio | YP (MPa) | TS (MPa) | E1 (%) | 2% BH (MPa) | 2% BH after artificial aging (MPa) |
| Ex. 1 | PF + M | 10 | 3.7 | 2.7 | 295 | 461 | 36 | 79 | 78 |
| Ex. 2 | PF + M | 8 | 3.9 | 2.8 | 289 | 456 | 35 | 81 | 81 |
| Ex. 4 | PF + M | 8 | 3.8 | 2.8 | 312 | 488 | 32 | 91 | 88 |
| Ex. 7 | PF + M | 9 | 3.8 | 3.0 | 320 | 460 | 35 | 88 | 86 |
| Ex. 8 | PF + M | 10 | 3.6 | 2.9 | 324 | 471 | 34 | 80 | 80 |
| Ex. 9 | PF + M | 9 | 3.8 | 2.8 | 293 | 470 | 34 | 71 | 65 |
| Ex. 10 | PF + M | 6 | 4.1 | 2.9 | 297 | 460 | 33 | 74 | 63 |
| Comp. Ex. 1 | BF | 100 | 1.0 | — | 322 | 456 | 33 | 58 | 56 |
| Comp. Ex. 2 | Processed F + M | 5 | 1.2 | 2.6 | 389 | 470 | 28 | 61 | 58 |
| Comp. Ex. 3 | BF | 100 | 1.0 | — | 318 | 460 | 31 | 60 | 55 |
| Comp. Ex. 4 | PF + P | 12 | 1.4 | 2.7 | 311 | 439 | 32 | 21 | 8 |
| Comp. Ex. 5 | PF + B | 5 | 4.0 | 1.4 | 320 | 460 | 31 | 55 | 45 |
| Comp. Ex. 6 | PF + M | 2 | 2.7 | 2.2 | 410 | 570 | 24 | 12 | 10 |
| Comp. Ex. 7 | PF + M | 11 | 3.6 | 2.6 | 303 | 465 | 34 | 76 | 36 |
| Comp. Ex. 8 | PF + B + 13% γR | 31 | 2.1 | 1.8 | 566 | 794 | 33 | 46 | 43 |

In the table, γR indicates residual austenite.
*1: Descaling was carried out after rough rolling under conditions of a collision pressure of 2.7 MPa and a flow rate of 0.001 liters/cm$^2$.
*2: The sheet was passed through a zinc plating step.

Thin steel sheets obtained in this exemplary manner were evaluated by tensile tests and BH tests after artificial aging in the same manner as the evaluation methods described herein above. Moreover, the microstructures of the steel sheets were similarly investigated, and the average grain sizes of the polygonal ferrite and the second phase, and the hardness ratio of the hard second phase to the main phase that is the polygonal ferrite, were measured. These exemplary results are shown in Table 3.

The hot rolled steel sheets of Examples 1 to 12 included the predetermined amounts of steel components, their microstructures includes a main phase in the form of polygonal ferrite and a hard second phase, the volume fractions of the second phases were 3 to 20%, the hardness ratios were 1.5 to 6, and the grain size ratios were 1.5 or more. In these Examples 1 to 12, the BH amount after artificial aging exceeded 60 MPa, and the hot rolled steel sheets for processing were obtained that have superior bake hardenability after aging.

Comparative Examples 1 to 8 other than those described above were outside the scope of the present invention for the reasons described below.

In Comparative Example 1, since the reduction rate of the final stage and the sum of reduction rates of the final stage and the stage prior thereto were outside the range of one exemplary embodiment of the present invention, the target microstructure described in the exemplary embodiment could not be obtained; thereby, adequate BH amount after artificial aging was not realized.

In Comparative Example 2, since the finishing temperature (FT) at completion of finish rolling was outside the range of the exemplary embodiment, the target microstructure described in the exemplary embodiment could not be obtained; thereby, adequate BH amount after artificial aging was not realized.

In Comparative Example 3, since the holding time was outside the range of the exemplary embodiment of the present invention, the target microstructure provided for the exemplary embodiment of the present invention was not obtained.

In Comparative Example 4, the cooling rate in a temperature range from the holding temperature to 350° C. was outside the range of the exemplary embodiment of the present invention. In particular, since the cooling rate in a temperature range from the holding temperature to 350° C. was less than 100° C./sec., pearlite was formed. Thus, the target microstructure provided the exemplary embodiment of the present invention was not obtained; thereby, adequate BH amount after artificial aging was not realized.

In Comparative Example 5, since the reduction rate of the final stage was outside the range of the exemplary embodiment of the present invention the target microstructure described in the exemplary embodiment was not obtained; thereby, adequate BH amount after artificial aging was not realized.

In Comparative Example 6, since the content of Si in the slab Y1 used was outside the range of the exemplary embodiment of the present invention, the target microstructure described in the exemplary embodiment was not obtained; thereby, adequate BH amount after artificial aging was not realized.

In Comparative Example 7, the target microstructure provided in the exemplary embodiment of the present invention was obtained; however, since the content of N in the slab Y2 used was outside the range of the exemplary embodiment, aging deterioration was excessive; thereby, adequate BH amount after artificial aging was not realized.

In Comparative Example 8, the contents of C and Si in the slab Y3 used were outside the range of the exemplary embodiment of the present invention, and the coiling temperature was outside the range of the exemplary embodiment. Therefore, the target microstructure described in this exemplary embodiment was not obtained.

EXEMPLARY INDUSTRIAL APPLICABILITY

Since this hot rolled steel sheet for processing is capable of demonstrating a stable BH amount of 60 MPa or more due to the small amount of the decrease in the BH amount caused by aging, pressed product strength can be obtained which is equivalent or similar to that of a pressed product manufactured by applying steel sheets having tensile strength of 540 to 640 MPa, as a result of introduction of pressing stress and baking finish treatment, even when the tensile strength of the hot rolled steel sheet is 370 to 490 MPa.

Consequently, this exemplary embodiment of a hot rolled steel sheet for processing can be preferably used as steel sheet for industrial products to which reduction of gauges are strongly required for the purpose of achieving weight saving, as in the case of chassis parts, etc. of automobiles and other products.

The foregoing merely illustrates the exemplary principles of the present invention. Various modifications and alterations to the described embodiments will be apparent to those skilled in the art in view of the teachings herein. It will thus be appreciated that those skilled in the art will be able to devise numerous modification to the exemplary embodiments of the present invention which, although not explicitly shown or described herein, embody the principles of the invention and are thus within the spirit and scope of the invention. All publications, applications and patents cited above are incorporated herein by reference in their entireties.

The invention claimed is:

1. A hot-rolled steel sheet for processing and having a superior bake hardenability after aging, comprising:

at least one portion which comprises, in terms of percent by mass,

C of approximately 0.01% to 0.2%,

Si of approximately 0.01 to 0.3%,

Mn of at most approximately (1.5-Si) %,

P of at most approximately 0.1%,

S of at most approximately 0.03%,

Al of approximately 0.001% to 0.1%,

N of at most approximately 0.006%, and a remainder of Fe and unavoidable impurities, wherein a microstructure consists essentially of a main phase having a form of a polygonal ferrite and a hard second phase of martensite, wherein a volume fraction of the hard second phase is approximately 3% to 20%, a hardness ratio of a hardness of the hard second phase to a hardness of the polygonal ferrite is about 1.5 to 6, and a grain size ratio of a grain size of the polygonal ferrite to a grain size of the hard second phase is at least approximately 1.5, wherein a BH amount after aging is at least approximately 60 MPa, and wherein the hot-rolled steel sheet is manufactured by:

i. rough-rolling a slab to obtain a rough rolled bar, the slab including, in terms of percent by mass, C of approximately 0.01% to 0.2%, Si of approximately 0.01 to 0.3%, Mn of at most approximately (1.5-Si) %, P of at most approximately 0.1%, S of at most approximately 0.03% Al of approximately 0.001% to 0.1%, N of at most approximately 0.006%, and a remainder of Fe and unavoidable impurities, ii. finish rolling the rough rolled bar to obtain a rolled steel under conditions in which a sum of reduction rates of a final stage and a stage prior to the final stage is at least approximately 25%, a reduction rate of the final stage is about 1% to 15%, and a finishing temperature is in a temperature range from approximately an $Ar_3$ transformation point temperature to an $Ar_3$ transformation point temperature +100° C., iii. maintaining the rolled steel in a temperature range from approximately below the $Ar_3$ transformation point temperature to at least the $Ar_1$ transformation temperature for approximately 1 second to 15 seconds, iv. cooling the rolled steel to a temperature of approximately 350° C. at a cooling rate of approximately at least 100° C./sec to obtain the hot-rolled steel sheet; and v. coiling the hot-rolled steel sheet at a temperature of below approximately 350° C.

2. The hot-rolled steel sheet for processing according to claim 1, wherein the at least one portion further comprises, in terms of percent by mass, at least one of:

B of approximately 0.0002% to 0.002%,

Cu of approximately 0.2% to 1.2%,

Ni of approximately 0.1% to 0.6%,

Mo of approximately 0.05% to 1%,

V of approximately 0.02% to 0.2%, or

Cr of approximately 0.0 1% to 1%.

3. The hot-rolled steel sheet for processing according to claim 1, wherein the at least one portion further comprises, in terms of percent by mass, at least one of:

Ca of approximately 0.0005% to 0.005%, or

REM of approximately 0.0005% to 0.02%.

4. The hot-rolled steel sheet for processing according to claim 1, wherein the at least one portion is treated with zinc plating.

5. The hot-rolled steel sheet for processing according to claim 1, wherein the hot-rolled steel sheet has a tensile strength of about 370 Mpa to 490 Mpa.

* * * * *